United States Patent [19]

Vickery

[11] 4,408,368

[45] Oct. 11, 1983

[54] CHIMNEY CLEANING DEVICE

[75] Inventor: Donald P. Vickery, Gloversville, N.Y.

[73] Assignee: Nelson A. Taylor Co., Inc., Gloversville, N.Y.

[21] Appl. No.: 282,968

[22] Filed: Jul. 13, 1981

[51] Int. Cl.[3] ..... F23J 3/00

[52] U.S. Cl. ..... 15/243; 15/104.07

[58] Field of Search ..... 15/242, 243, 162, 163, 15/249, 104.07; 134/8

[56] References Cited

U.S. PATENT DOCUMENTS

| | | | |
|---|---|---|---|
| 283,205 | 8/1883 | Clark | 15/104.07 |
| 920,544 | 5/1909 | Cope | 15/104.07 |
| 3,108,302 | 10/1963 | Whiteis | 15/104.07 |
| 4,028,769 | 6/1977 | Coviello et al. | 15/249 |
| 4,254,528 | 3/1981 | Souliere | 15/243 |
| 4,261,073 | 4/1981 | Lane | 15/243 X |

*Primary Examiner*—Edward L. Roberts
*Attorney, Agent, or Firm*—Robert E. Heslin

[57] ABSTRACT

Discloses a portable chimney device for removing creosote deposits and soot from a chimney flue while the chimney is in operation, or during a chimney fire, and without said device causing damage to the chimney flue, its liner, or chimney bottom. The device has a frame mounting a drum reel whose cable is operatively connected to an impacting weight freely carrying upper and lower cutters with a spacer ring therebetween, with such cutters disposed between upper and bottom rings fixed to the impacting weight. Upward and downward movements of the frame transmit ramming impact by means of the fixed rings to the cutters to effect removal of the creosote deposits and soot. Also discloses a portable chimney device to clean the chimney flue of creosote deposits and soot as a matter of periodic maintenance. The device has a frame mounting a drum reel whose cable is operatively connected to an impacting weight freely mounting spacer washers and a sub-assembly of upper and lower washers sandwiching articulated, spring-steel picks. Such sub-assembly is freely carried on the impacting weight between the spacer washers. Upward and downward movements of the frame transmit ramming impact to the sub-assembly of picks through the spacer washers with removal of the creosote deposits and soot effected by engagement of the picks therewith, and with such articulation of the picks causing unidirectional rotation of the picks.

11 Claims, 15 Drawing Figures

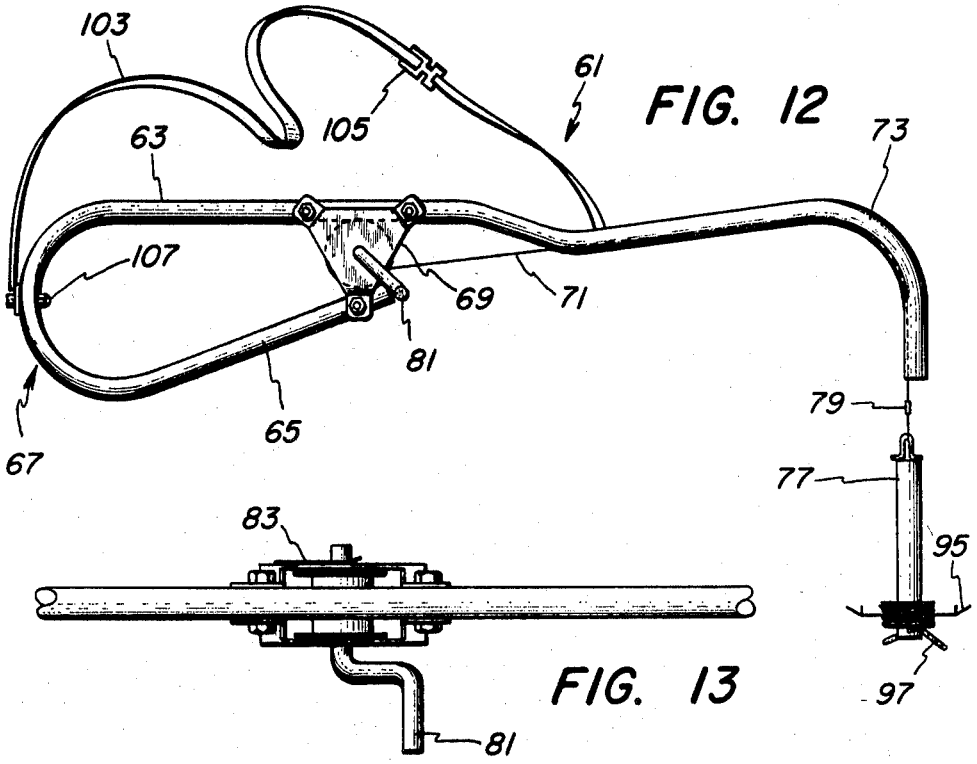
FIG. 12
FIG. 13
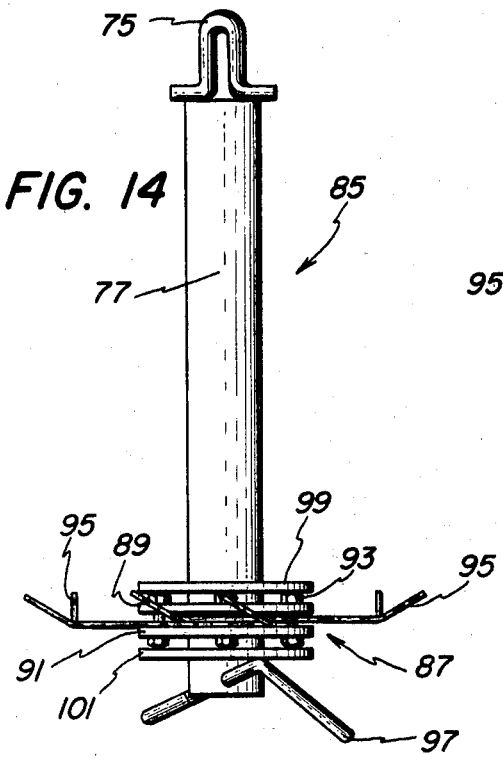
FIG. 14
FIG. 15
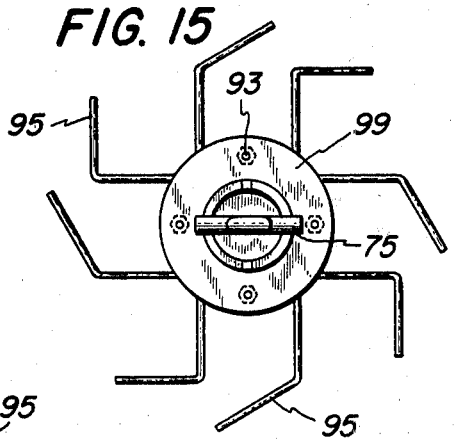

CHIMNEY CLEANING DEVICE

BACKGROUND OF THE INVENTION

Technical Field

This invention relates to a chimney device.

Each year, there are several hundred thousand chimney fires, with the major cause of dangerous chimney fires being the accumulation of creosote and soot. There are three types of creosote. Airtight stoves are heavy producers of creosote which in the form of a gas rises up the chimney and condenses on the flue at the point at which it has cooled to the 255° F. temperature range. Such creosote condensate coats the flue with deposits whose build-up does not usually block the flue, but results in the flue opening or aperture becoming smaller. In a chimney fire, such creosote deposits burn and expand to a light-weight, crusty material two to three times original volume to block the flue partially or totally, or such crusty material slips down the flue and becomes lodged therein to block the flue. A chimney fire quickly reaches the temperature range of 1,500° F. to 3,000° F. causing the mortar to melt from between the joints of the masonry flues and causing disintegration of the clay flue tiles. Using water to extinguish a chimney fire results in rapid quenching with resultant damage to the clay tile liners.

The first embodiment of the invention significantly contributes to solving such discussed problems by unblocking the chimney flue even while a chimney fire is in progress without any resulting damage to the chimney flue. The second invention embodiment can be employed to clean the chimney thereafter of remaining creosote deposits and soot; or can be employed as a preventive measure to periodically clean the chimney flue of creosote deposits and soot so that there can be no subsequent chimney fire from creosote deposits and soot. Such second invention embodiment can also be used while the chimney is in operation. Significantly, the human operator, in operating either of the embodiments, does so while standing or positioning himself away from the chimney and thereby does not suffer smoke inhalation or injury to his eyes, face, hands or body by exposure to flames shooting up the chimney.

Accordingly, the object of the first embodiment is to provide a chimney device to unplug and remove creosote deposits and soot while the chimney is in operation, with even a roaring fire in such chimney; and the object of the second embodiment is to clean the flue of creosote deposits and soot. Either embodiment can be used and operated without injury to the human operator.

SUMMARY OF THE INVENTION

In accordance with the invention, there is provided a portable chimney device that one person can carry on his shoulder up the ladder to the roof for access to the top of the chimney flue whereat the head of the device is appropriately disposed, introduced into the chimney flue and operated to unplug and remove the creosote deposits obstructing the chimney flue.

The device is in the form of a main frame configured to be carried around the human operator's shoulder and arm. A drum reel has wound thereon cable which carries the head. Such drum reel allows such cable to be wound thereon or payed therefrom through a tubular cable guide. The human operator grasps the device and appropriately disposes same in operative position relative to the top of the chimney flue for introduction therein of its head. Sufficient cable is appropriately payed out from the drum reel in order that such head will reach and engage such creosote deposits and soot blocking the chimney flue. By appropriate up and down movement of the device, the head's impacting weight and cutters will ram through such blocking, chimney-flue deposits and soot, and thereby permit the cutters to cut away and remove such creosote deposits and soot from the chimney flue.

A second embodiment and modification has a pick-cleaning sub-assembly mounted on an impact weight of a head. Up and down movement of such head permits the articulated picks of the pick-cleaning sub-assembly to clean the chimney flue of creosote deposits and soot.

BRIEF DESCRIPTION OF THE DRAWINGS

This object and other objects of the invention should be discerned and appreciated by reference to the drawings wherein like reference numerals refer to similar parts throughout the several views, in which:

FIG. 12 is a side view of the other embodiment that has a pick-cleaning sub-assembly mounted on an impacting weight of a head;

FIG. 13 is a partial top view of FIG. 12;

FIG. 14 is a view of the head of the embodiment shown in FIG. 12, and shows the pick-cleaning sub-assembly mounted on the cylindrical impacting weight;

FIG. 15 is a top view of the pick-cleaning sub-assembly with its articulated, spring-steel picks.

DESCRIPTION OF THE PREFERRED EMBODIMENT

Figure 1:
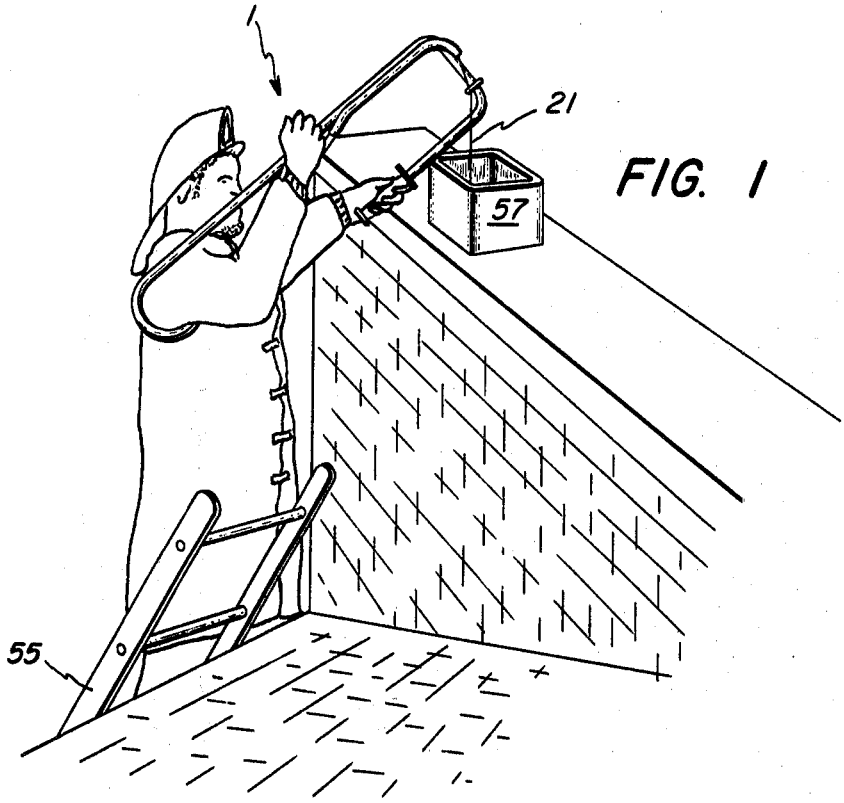
FIG. 1 shows a fireman with the device on his shoulder and with such device in operative position respect to the chimney flue.
Figure 2:
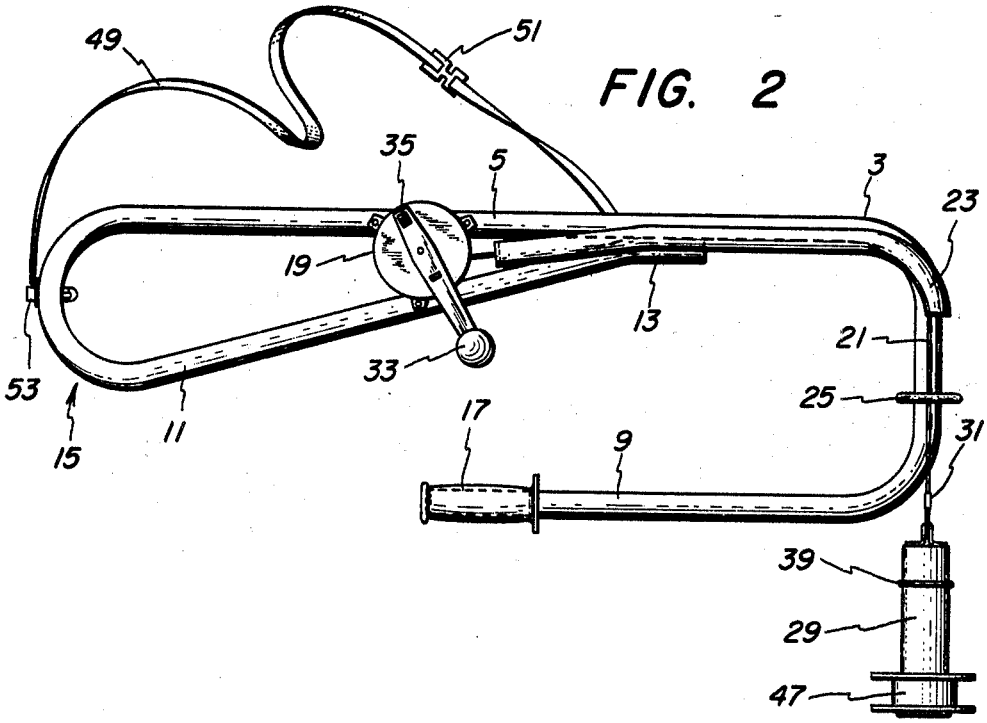
FIG. 2 is a side view of the device.
Figure 3:
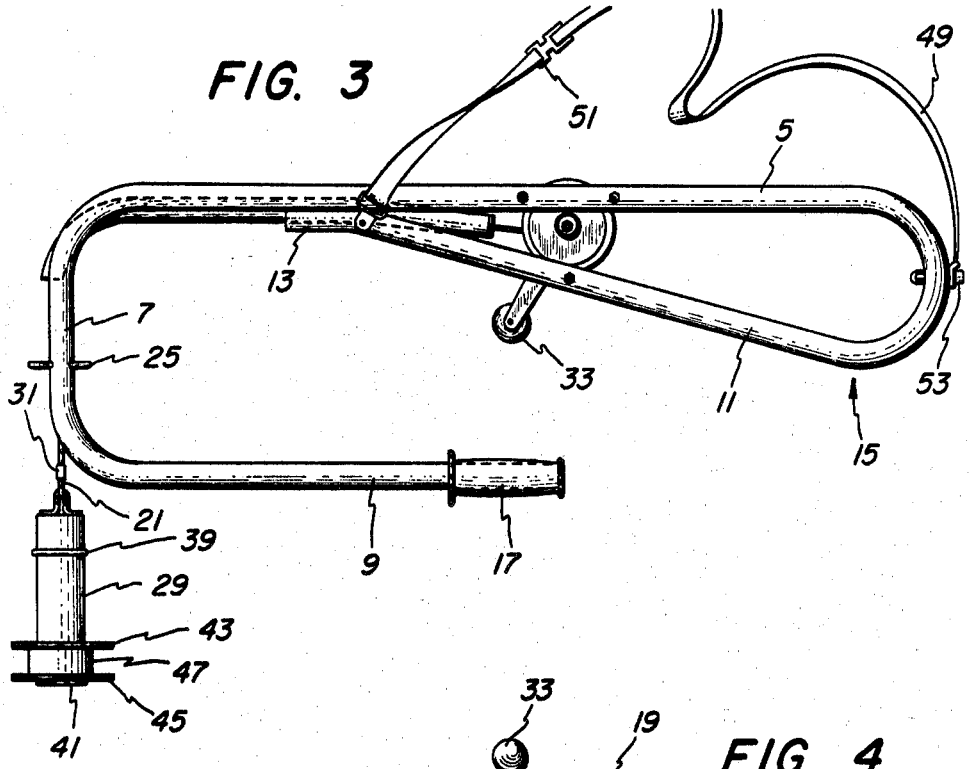
FIG. 3 is a view of the device from its opposite side.
Figure 4:
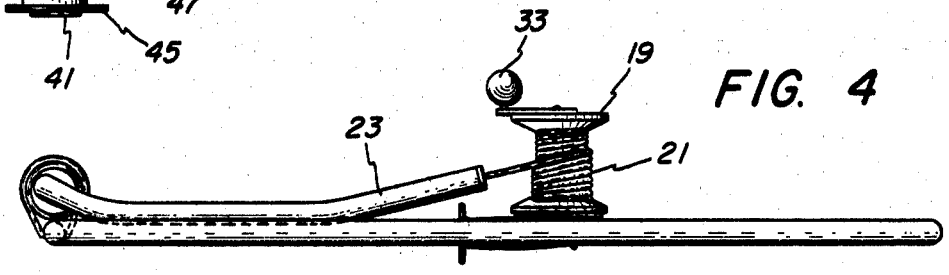
FIG. 4 is a view of the device from the top of FIG. 3.
Figure 5:
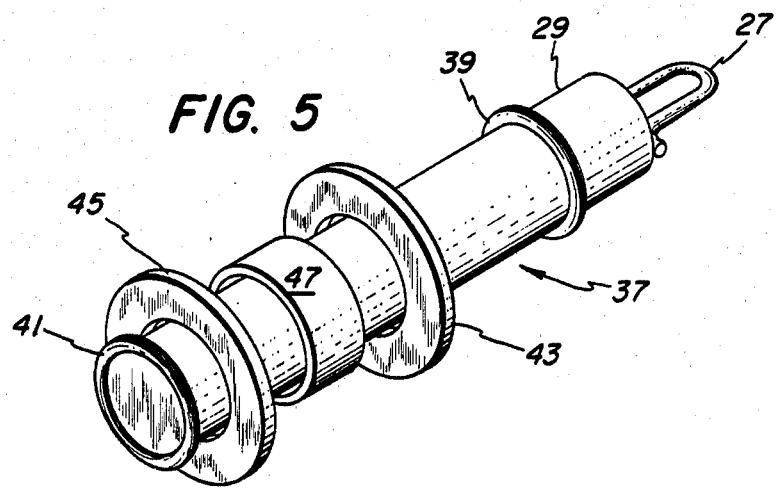
FIG. 5 is an isometric view of the head.
Figure 6:
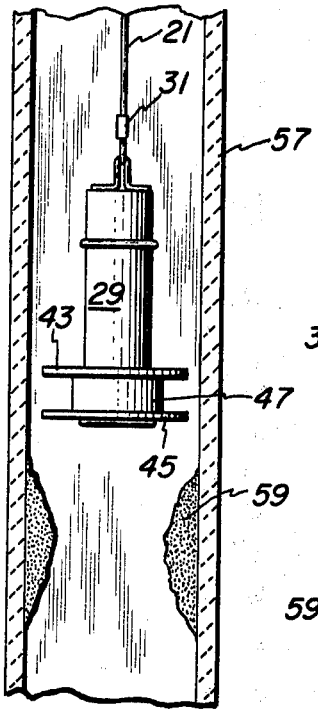
FIG. 6 is a view of the head in descending position with respect to the chimney flue and obstruction of creosote deposits and soot therein, and preparatory to engaging such obstruction.
Figure 7:
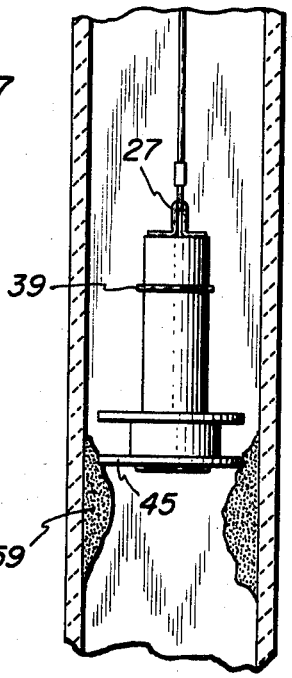
FIG. 7 is a view of the lower cutter, mounted on the impacting weight of the head, engaging such obstruction in the chimney flue.
Figure 8:
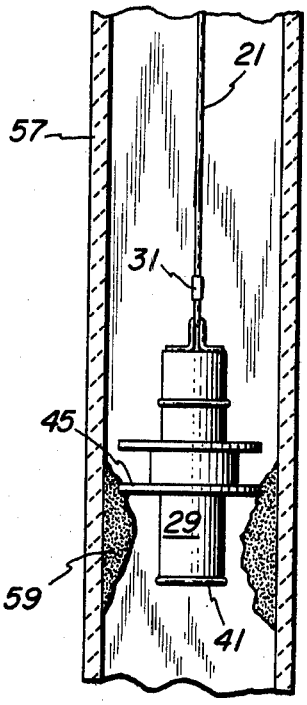
FIG. 8 is a view showing such lower cutter engaged with and stopped by such obstruction in the chimney flue, and shows the impacting weight proceeding through such obstruction.
Figure 9:
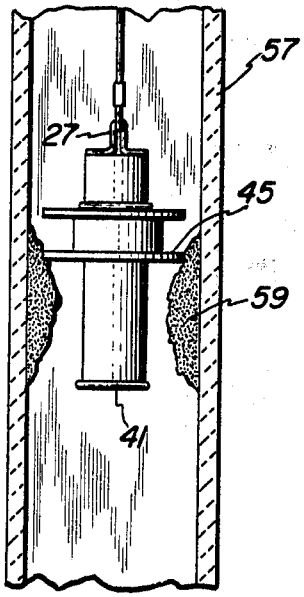
FIG. 9 is a view showing the upper ring, fixed to the impacting weight, engaging the upper cutter to thereby transmit through spacer ring to lower cutter ramming action whereby such lower cutter engages and rams itself through such obstruction.
Figure 10:
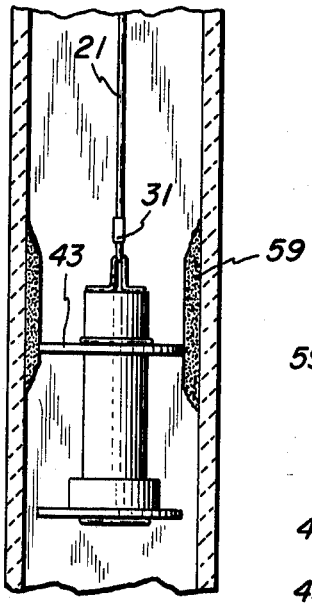
FIG. 10 is a view showing the lower cutter rammed through such obstruction and shows such upper ring engaged with the upper cutter ramming itself through whatever remains of such obstruction.
Figure 11:
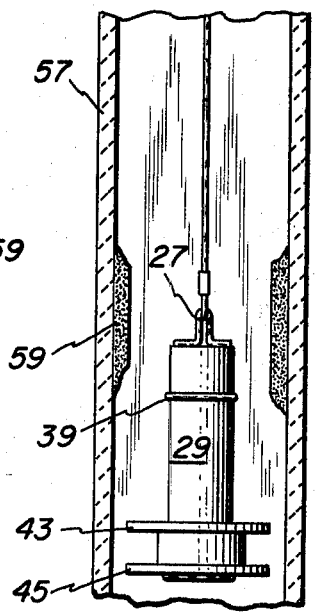
FIG. 11 is a view showing the upper and lower cutters rammed through such obstruction, and with the upper and lower cutters returned to the bottom of the impacting weight by gravity action.

In FIG. 1 of the drawings, reference numeral 1 generally refers to the chimney device comprising a tubular main frame 3 of suitable material. As shown more discernable in FIGS. 2 and 3, main frame 3, of integral, one-piece construction, has a horizontally disposed upper portion 5, a vertically disposed portion 7 and a horizontally disposed lower portion 9. An angled-back portion 11 has its end 13 suitable fixed to upper portion 5, and defines a closed loop 15 configured to be carried in mounting relationship around the human operator's shoulder and/or beneath his arm pit. A hand grip 17 is carried on the terminal end of lower horizontal portion 9. A drum reel 19, bolted to closed loop 15, has wound thereon cable 21, trained through an articulated, tubular cable guide 23 suitably fixed to upper portion 5 and through a weight guide holder ring 25 suitably fixed to vertical portion 7. The end of cable 21 is looped through an inverted, U-shaped rod 27, fixed to cylindrical impacting weight 29, and such part of cable 21 forms such looped end by means of a brass swedge or connector 31. Upper and lower portions 5 and 9 are substantially parallel to each other and substantially normal to vertical portion 7.

The conventional drum reel 19, upon whose drum the cable 21 is wound, operates to either wind cable 21 on the drum or pay same out. Handle 33, through suitable reduction gearing, unidirectionally and operatively drives the drum to wind cable 21 thereon. Drum reel 19 incorporates a release tab 35 operative to disconnect the gearing to allow opposite unidirectional, free-wheeling rotation of the drum to allow the cable 21 to be payed out.

The head 37 comprises the cylindrical impacting weight 29 to which are suitably fixed external upper and bottom rings 39 and 41 which act as limit stops between which are freely mounted upper and lower cutters 43 and 45 with spacer ring 47 therebetween.

A shoulder strap 49, adjustable in length for carrying over one's shoulder by means of its strap adjuster 51, is suitably mounted on the device 1 by strap mounting bolts 53.

In operative use, the human operator carries the device 1 by means of the shoulder strap 49 and climbs a ladder 55 prepositioned for immediate and convenient access to the chimney flue 57 blocked by creosote deposits 59.

The human operator appropriately grasps the device in his left hand by its hand grip 17 and appropriately grasps with his right hand the handle 33 of the drum reel 19. The device 1 is appropriately disposed relative to chimney flue 57 such that head 37 can be introduced therein. Tab 35 is appropriately actuated to allow cable 21 to be payed out and hence allow head 37 by force of gravity to descend the chimney flue 57 until an obstruction of creosote deposits 59 is encountered. The ramming impact of the head 37 upon and with the creosote deposits 59 in the chimney flue 57 may be sufficient to carry head 37 through such obstruction of creosote deposits 59 to the bottom of the chimney flue 57 to thereby unblock the chimney flue 57. If such be the case, then handle 33 can be appropriately manipulated to rewind the cable 21 sufficiently on drum reel 19 so that the upper portion of the cylindrical impact weight 29 will be received in its storage position within weight guide holder ring 25. The human operator can thereafter carry the device by means of shoulder strap 49, descend the ladder 55 and appropriately dispose the device 1 in storage position with drum reel 19 in the up position.

If the ramming impact of the head 37 upon and with the creosote deposits 59 in the chimney flue 57 is not sufficient to carry head 37 through such obstruction of creosote deposits 59, the ram-tapping action of the head 37 will need to be employed. In this case, tab 35 is appropriately actuated to lock the drum reel 19 to prevent any more cable 21 from being payed out or unwound. Sufficient up and down movement of the head 37 is effected by corresponding up and down movement of frame 3 such that impacting weight 29 will engage, ram and break through the creosote deposits 59. Such up and down movement will also cause the lower cutter 45 to engage, ram and clear away the creosote deposits 59 upon downward movement of head 37 through impacting ramming contact of upper ring 39 with upper cutter 43, and hence upper cutter 43 with spacer ring 47, and spacer ring 47 with lower cutter 45. After such up and down movement is repeated enough times, an opening will be cleared away through such creosote deposits 59 to permit descent of the head 37 to the bottom of the chimney flue 57. Moreover, it should be appreciated that upward movement of the head 37 will cause the bottom ring 41 to transmit upward ramming action of the upper cutter 43 with such remaining creosote deposits 59 that obstruct chimney flue 57 because, by reason of gravity, bottom ring 41 is already in contact with lower cutter 45, lower cutter 45 is in contact with spacer ring 47, and spacer ring 47 is in contact with upper cutter 43. It should be appreciated that since the cutters 43 and 45 are of appropriate non-ferrous metal, such lack of hardness of cutters 43 and 45 will protect the tile liner of the chimney flue 57 against damage in comparison to the damage that otherwise would result to the tile liner of the chimney flue 57 were steel cutters 43 and 45 employed.

In FIG. 12 of the drawings, reference numeral 61 generally refers to the second embodiment of a chimney device comprising a tubular main frame 63 of suitable material. An angled-back portion 65 defines a closed loop 67 configured to be carried in mounting relationship around the human operator's shoulder and/or beneath his arm pit. A drum reel 69, bolted to closed loop 67, has wound thereon cable 71, trained through an articulated, tubular cable guide portion 73 of main frame 63, as shown. The end of cable 71 is looped through an inverted, U-shaped rod 75, fixed to cylindrical impacting weight 77, and such part of cable 71 forms such looped end by means of an appropriate brass swedge or connector 79.

The conventional drum reel 69, upon whose drum the cable 71 is wound, operates to wind cable 71 on the drum or pay same out. Handle 81, operatively connected with drum reel 69, and by means of operatively engaged rathchet 83, unidirectionally and operatively drives the drum to wind cable 71 thereon. Appropriate manipulative release and disengagement of the pawl of ratchet 83 operates to allow opposite unidirectional, free-wheeling rotation of the drum to allow the cable 71 to be payed out.

The head 85 comprises the cylindrical impacting weight 77 which carries freely thereon the pick-cleaning sub-assembly 87. Pick-cleaning sub-assembly 87 comprises upper and lower washers 89 and 91 that are appropriately bolted together by nuts and bolts 93. Washers 89 and 91 thereby sandwich therebetween articulated, spring-steel picks 95. Spring-holding clip 97 is appropriately disposed through and retained by a hole formed through the bottom of cylindrical impacting weight 77. Upper and lower spacer washers 99 and 101 are interposed between U-shaped rod 75 and upper washer 89, and between lower washer 91 and spring-holding clip 97, respectively.

The spacer washers 99 and 101 have several functions. The spacer washers 99 and 101 act as ram cleaners to keep the cylindrical impacting weight 77 free of creosote or soot. The spacer washers 99 and 101 prevent the bolt heads and nuts 93 from being hung up on the U-shaped rod 75 or the spring-holding clip 97. The spacer washer 101 prevents the sub-assembly 87 from being canted and thereby wedged on cylindrical impacting weight 77 from contact with the spring-holding clip 97. The spacer washers 99 and 101 act as bearing surfaces for the bolt heads and nuts 93 thereby enhancing the rotation of sub-assembly 87 relative to cylindrical impacting weight 77. The actual model of the sub-assembly 87 would have at least double the number of articulated, spring-steel picks 95. A fewer number of articulated, spring-steel picks 95 are shown so as not to clutter up the drawings.

Free movement of sub-assembly 87 on cylindrical impacting weight 77 is limited between U-shaped rod 75 and spring-holding clip 97 in the upward direction by upper spacer washer 99 engaging U-shaped rod 75, and in the downward direction by lower spacer washer 101 engaging spring-holding clip 97. Spring-holding clip 97, in addition to its described function as a limit stop, further functions and acts as a shock absorber to lessen the impact of the cylindrical impacting weight 77 upon the bottom of the chimney so as not to break-up or otherwise damage such chimney bottom.

A shoulder strap 103, adjustable in length for carrying over one's shoulder by means of its strap adjuster 105, is suitably mounted on the device 61 by strap mounting bolts 107.

In operative use, the human operator carries the device 61 by means of the shoulder strap 103 and climbs the ladder 55 prepositioned for immediate and convenient access to the chimney flue 57 blocked by creosote deposits 59.

The human operator appropriately grasps a convenient part of the main frame 63 in his left hand and appropriately grasps with his right hand the handle 81 of the drum reel 69. The device 61 is appropriately disposed relative to chimney flue 57 such that the head 85 can be introduced therein. The pawl of ratchet 83 is appropriately manipulated to operatively disengage same from ratchet 83 to allow cable 71 to be payed out from the drum and hence to allow head 85, by force of gravity, to descend the chimney flue 57 until an obstruction of creosote deposits 59 is encountered. The ramming impact of the cylindrical impacting weight 77 of head 85 upon and with the creosote deposits 59 in the chimney flue 57 may be sufficient to carry head 85 sufficiently into the creosote deposits 59 to allow the articulated, spring-steel picks 95 to intermittently pick away at and dislodge such deposits 59 and cause counter-clockwise rotation of sub-assembly 87 whereby its picks 95 pick away at and dislodge such deposits 59. Sufficient repeated up and down movements of head 85 effectuated by corresponding up and down movements of frame 63 will cause picks 95 to pick away at, dislodge and remove such creosote deposits 59. Additional cable 71 may need to be payed out in order for the head 85 to descend further down chimney flue 57 and allow the steel picks 95 to pick away at, dislodge and remove all of such creosote deposits 59. With such downward movement of head 85 and engagement of the articulated, spring-steel picks 95 with such creosote deposits 59, the sub-assembly 87 will be caused to rotate slightly in a counterclockwise direction; and upon upward movement of head 85 and engagement of the articulated, spring-steel picks 95 with such creosote deposits 59, the sub-assembly 87 will be caused to rotate in the same direction.

In both embodiments and as not countenanced in the prior art, both devices can be utilized to remove creosote deposits while the chimney is in use and a fire is burning in the stove, or even while there is a fire in the chimney. In fact, if either device is employed while the chimney is in operation and use, much of the loosened creosote deposits 59 and soot will be exhausted from the chimney and not collect on the bottom of the chimney. In addition, the possibility of damage to the chimney flue 57, its tile liner or the bottom of the chimney will be minimal.

It should be appreciated also that U-shaped rod 75 and spring-holding clip 97 further serve to transmit ramming impact to the pick-cleaning sub-assembly 87 by up and down movements of the cylindrical impacting weight 77. Upon downward movement of cylindrical impacting weight 77, U-shaped rod 75 will engage upper spacer washer 99 to transmit downward ramming impact to the spring-steel picks 85 through upper spacer washer 99 to upper washer 89. Upon upward movement of cylindrical impacting weight 77, spring-holding clip 97 will engage lower spacer washer 101 to transmit upward ramming impact to the spring-steel picks 95 through lower spacer washer 101 to lower washer 91.

After the chimney flue 57 has been cleaned of creosote deposits 59 and soot, the device 61 is prepared for storage by appropriately manipulating the pawl of ratchet 83 to engage same and then appropriately manipulating handle 81 to rewind the cable 71 on drum reel 69. If cable 71 is rewound sufficiently on drum reel 69, U-shaped rod 75 will be received for storage position within the end of cable guide portion 73 of main frame 63.

None of the prior-art devices structurally incorporates a portable, self-contained device that can be utilized to remove creosote deposits and soot from the chimney flue 57 while the chimney is in operation or while a roaring chimney fire is in progress. Since the device takes advantage of the fact that it can be employed and operated while the chimney is in operation or a fire is in progress, much of the creosote deposits 59 and soot are blown out of and away from the chimney flue 57 with the result that there is little messy clean up remaining from such creosote deposits 59 and soot at the bottom of the chimney. While the second invention embodiment 61 is structurally embodied to clean the chimney flue 57 of creosote deposits 59 and soot, it can be made use of to unblock a chimney flue 57 blocked from creosote deposits 59 that have burned and expanded, but the second invention embodiment 61 would not accomplish this task as quickly and as efficiently as the first invention embodiment 1. Commercially, it is contemplated that the first invention embodiment 1 will be sold as a fire-department model, while the second invention embodiment 61 will be sold as a do-it-yourself, home model. No device that has been invented or is on the market is known to functionally incorporate the features of portability and safety which both embodiments of the invention have. Both embodiments can be utilized to remove creosote deposits 59 and soot while the chimney is in operation but without the problems of smoke inhalation or injury to the human operator's eyes, face, hands or body from smoke or fire, and without the problems of damage to the chimney flue 57 or chimney bottom. In the prior art, when the fire department arrives at the scene of a chimney fire, the fire must first be put out before the chimney can be unblocked of its creosote deposits 59. This requires extinguishing the chimney fire by applying water or other extinguishing agents with resultant damage to the chimney flue 57. And, more importantly in terms of human values, this means the fireman risks injury and physical incapacity from smoke inhalation and injuries to his eyes, face, hands and body from smoke and fire. Since both embodiments are compact, portable and self-contained devices, either device can be carried on a human operator's shoulder while he climbs a ladder to the roof for access to the chimney. He positions himself safely to one side of the chimney flue 57 and preferably upwind of the chimney flue 57. So positioned safely to one side and away from the top of the chimney flue 57 and upwind thereof, the human operator can then begin to employ and operate either device to operatively introduce such device's head within the chimney flue 57 to remove the creosote deposits 59 and soot, but without any risk from smoke inhalation or injuries to his eyes, face, hands and body from smoke and fire.

Having thusly described my invention, I claim:

1. A chimney device for removing creosote deposits and soot from a chimney flue while the chimney is in operation, or during a chimney fire, and without said device causing damage to the chimney flue, its tile liner or chimney bottom, said device having a head for removing said creosote deposits and soot comprising an impacting weight, an upper ring and a bottom ring, an upper cutter and a lower cutter for engaging and removing creosote deposits and soot, and a spacer ring between said cutters, wherein said impacting weight carries said upper and bottom rings and said cutters and spacer ring and wherein said upper and bottom rings act as limit stops to limit movement of said cutters therebetween and to transmit ramming impact to said cutters upon up and down movements of said impacting weight.

2. A chimney device in accordance with claim 1, wherein said device has a frame for carrying of same by a human operator and wherein said frame is operatively connected to said head.

3. A chimney device in accordance with claim 1, wherein said device has a frame for carrying of same by a human operator, wherein said frame has a portion configured as a defining a closed loop for carrying said device in operative mounting relationship around said human operator's shoulder, and wherein said frame operatively carries said head.

4. A chimney device in accordance with claim 1, wherein said device has a frame for portable carrying of same by a human operator, wherein said frame carries cable means, and wherein said cable means is operatively connected to said head.

5. A chimney device in accordance with claim 1, wherein said device has a reel, wherein said reel carries cable means, wherein said cable means is operatively connected to said head, and wherein said reel is operable to wind said cable means thereon or pay same out.

6. A chimney device in accordance with claim 1, wherein said device has a frame and cable guide, wherein said frame carries said cable guide, wherein said device has cable operatively connected to said head, and wherein said cable guide trains said cable therethrough.

7. A chimney device in accordance with claim 1, wherein said device has a shoulder strap for disposition over a human operator's shoulder for portable carrying of said device.

8. A chimney device in accordance with claim 1, wherein said device has a frame of integral, one-piece construction, wherein said frame has an upper portion and angled-back portion defining a closed loop for carrying said device in operative mounting relationship around a human operator's shoulder.

9. A chimney device in accordance with claim 1 wherein the upper ring and the bottom ring are carried in fixed position with respect to each other by the impacting weight and the upper and lower cutters and the spacer ring are freely moveable on the impacting weight, wherein said cutters are operative for engaging and removing said creosote deposits and soot through ramming impact of said cutters, wherein said device has a frame operatively connected to said impacting weight, and wherein up and down movements of said frame transmit said ramming impact to said cutters.

10. A chimney device in accordance with claim 1, wherein said device has a frame for carrying of same by a human operator, wherein said frame has a portion configured as and defining a closed loop for carrying said device in operative mounting relationship around said human operator's shoulder, wherein said head has an impacting weight carrying cutters for engaging and removing said creosote deposits and soot, wherein said frame carries cable means, and wherein said cable means operatively carries said impacting weight.

11. A chimney device in accordance with claim 1, wherein said device has a frame for carrying of same by a human operator, wherein said frame has a portion configured as and defining a closed loop for carrying said device in operative mounting relationship around said human operator's shoulder, wherein said device has a reel, wherein said reel carries cable thereon, wherein said reel is operative to wind said cable thereon or pay same out, wherein said head has an impacting weight carrying cutters for engaging and removing said creosote deposits and soot, and wherein said cable is operatively connected to said impacting weight.

* * * * *